US011114050B2

(12) United States Patent
Shan

(10) Patent No.: US 11,114,050 B2
(45) Date of Patent: Sep. 7, 2021

(54) DRIVING METHOD AND DRIVING DEVICE OF DISPLAY PANEL, AND DISPLAY DEVICE

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/029,260

(22) Filed: Sep. 23, 2020

(65) Prior Publication Data

US 2021/0005152 A1 Jan. 7, 2021

Related U.S. Application Data

(63) Continuation of application No. PCT/CN2019/076253, filed on Feb. 27, 2019.

(30) Foreign Application Priority Data

Jan. 30, 2019 (CN) ..... 201910097393.5

(51) Int. Cl.
*G09G 3/36* (2006.01)

(52) U.S. Cl.
CPC ..... *G09G 3/3607* (2013.01); *G09G 3/3614* (2013.01); *G09G 3/3677* (2013.01); (Continued)

(58) Field of Classification Search
CPC .. G09G 3/3607; G09G 3/3614; G09G 3/3611; G09G 3/3677; G09G 2320/0242; G09G 2300/0452
See application file for complete search history.

(56) References Cited

U.S. PATENT DOCUMENTS

2017/0132982 A1* 5/2017 Zhang ..... G09G 3/3677
2018/0151138 A1* 5/2018 Jinta ..... G09G 3/20
(Continued)

FOREIGN PATENT DOCUMENTS

CN 1866350 A 11/2006
CN 101676985 A 3/2010
(Continued)

OTHER PUBLICATIONS

First Office Action in counterpart Chinese Application No. 201910097393.5, dated Nov. 29, 2019.
(Continued)

*Primary Examiner* — Dennis P Joseph
(74) *Attorney, Agent, or Firm* — Westbridge IP LLC

(57) ABSTRACT

Disclosed are a driving method, a display device, and a display equipment of a display panel. In the display array of the display panel of the present application, one row of subpixels have two different scanning drive signals, the odd-numbered column of the subpixels and the even-numbered column of the subpixels in one row are respectively driven by applying different scanning drive signals, each row of the subpixels are driven by applying two different scanning drive signals, and driving time of the scanning drive signal relative to a data drive signal is controlled to make each driving time of the two scanning drive signals be different from each other, thereby the color shift is reduced.

20 Claims, 5 Drawing Sheets

(52) U.S. Cl.
CPC ..... *G09G 2300/0452* (2013.01); *G09G 2320/0242* (2013.01)

(56) References Cited

U.S. PATENT DOCUMENTS

| | | | | |
|---|---|---|---|---|
| 2018/0322842 | A1* | 11/2018 | Hao ..... | G09G 3/3677 |
| 2019/0139507 | A1* | 5/2019 | Li ..... | G09G 3/3677 |
| 2019/0355320 | A1* | 11/2019 | Zhang ..... | G09G 3/3677 |

FOREIGN PATENT DOCUMENTS

| | | | |
|---|---|---|---|
| CN | 107045858 | A | 8/2017 |
| CN | 107065354 | A | 8/2017 |
| CN | 107507575 | A | 12/2017 |
| CN | 107886923 | A | 4/2018 |
| JP | 2008216893 | A | 9/2008 |

OTHER PUBLICATIONS

International Search Report and Written Opinion in corresponding PCT Application No. PCT/CN2019/076253, dated Oct. 17, 2019.
Second Office Action in counterpart Chinese Application No. 201910097393.5, dated May 15, 2020.

* cited by examiner

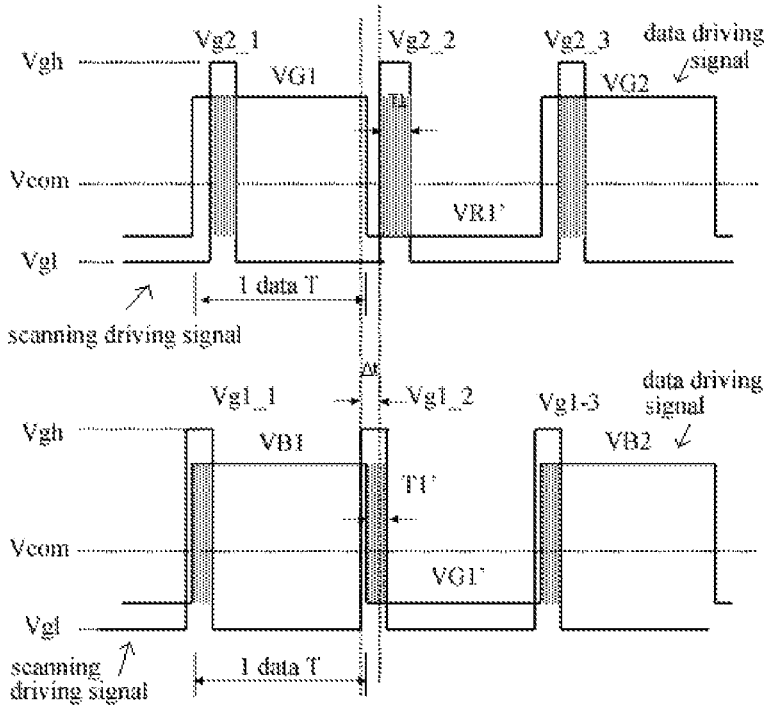

FIG. 3b acquiring a first scanning drive signal, a second scanning drive signal and a preset data drive signal, reducing drive time duration of the first scanning drive signal to make the drive time duration of the first scanning drive signal shorter with respect to drive time duration of the preset data drive signal, the first scanning drive signal includes a first main scanning signal and a first sub-scanning signal, and the second scanning drive signal includes a second main scanning signal and a second sub-scanning signal — S10

↓ taking two adjacent rows of the subpixels being scanned as a driving cycle, driving an even-numbered column of the subpixels in a first row of a driving cycle by applying the first main scanning signal, and driving an odd-numbered column of the subpixels in the first row by applying the second main scanning signal; and driving an odd-numbered column of the subpixels in a second row in the driving cycle by applying the first sub-scanning signal and an even-numbered column of the subpixels in the second row by applying the second sub-scanning signal — S20

FIG. 4

DRIVING METHOD AND DRIVING DEVICE OF DISPLAY PANEL, AND DISPLAY DEVICE

CROSS-REFERENCE OF RELATED APPLICATIONS

The present application is a continuation application of International Application No. PCT/CN2019/076253, filed on Feb. 27, 2019, which claims the benefit of Chinese Patent Application No. 201910097393.5, titled "DRIVING METHOD AND DRIVING DEVICE OF DISPLAY PANEL, AND DISPLAY DEVICE", filed in the National Intellectual Property Administration, PRC on Jan. 30, 2019, the entire contents of which are hereby incorporated by reference.

TECHNICAL FIELD

The present application relates to the technical field of liquid crystal panel display, and in particular, relates to a driving method of a display panel, a driving device of a display panel, and a display device.

BACKGROUND

The statements herein only provide background information related to present application and do not necessarily constitute prior Art.

Current large-size liquid crystal display panels are mostly negative Vertical Alignment (VA) liquid crystals or In-Plane Switching (IPS) liquid crystals.

Compared to IPS liquid crystal technology, VA liquid crystal technology may have higher production efficiency and a lower manufacturing cost. However it has obvious optical property defects, being inferior to IPS liquid crystal technology in optical properties.

Especially for large-sized display panels, the brightness of pixels linearly changes with the voltage during the drive of VA liquid crystal, when the display panel is viewed in a smaller viewing angle such as viewed in the front. If the display panel is viewed at a larger viewing angle, the brightness of the pixels rapidly saturates with the voltage, causing serious deterioration of image quality in viewing angles. Obviously, there is a big difference between the ideal curve and the actual curve, making the gray scale that should have been presented under a larger viewing angle change due to deterioration. As a result, color shift is generated.

The general solution to improve the color shift of VA liquid crystal is to further divide subpixels into main pixels and sub-pixels. After the division, when the display panel is viewed in a larger viewing angle, the brightness of the pixel changes with the voltage in a way close to that when the display panel is viewed with a smaller viewing angle.

However, the method of such division solves the color shift problem by giving different driving voltages to the main and sub-pixels in space. As a result, the method requires to re-design the metal traces or thin film transistors (TFT) to drive the sub-pixels when the pixel being designed, which causes reduction of the transparent opening area and further affects the panel transmittance.

Therefore, it may be considered that the existing method may not well alleviate the color shift due to its adverse effect on panel transmittance.

SUMMARY

The main object of the present application is to provide a driving method and a display device of display panel and a display device to effectively improve the color shift without affecting the transmittance of the panel.

In order to achieve the above object, the application provides a driving method of display panel, the display panel includes a display array comprising pixels arranged in an array, each pixel consists of three subpixels; and the driving method of the display panel includes:

acquiring a first scanning drive signal, a second scanning drive signal and a preset data drive signal, reducing drive time duration of the first scanning drive signal to make the drive time duration of the first scanning drive signal shorter with respect to drive time duration of the preset data drive signal, the first scanning drive signal includes a first main scanning signal and a first sub-scanning signal, and the second scanning drive signal includes a second main scanning signal and a second sub-scanning signal; and taking two adjacent rows of the subpixels being scanned as a driving cycle, driving an even-numbered column of the subpixels in a first row of a driving cycle by applying the first main scanning signal, and driving an odd-numbered column of the subpixels in the first row by applying the second main scanning signal; and to drive an odd-numbered column of the subpixels in a second row in the driving cycle by applying the first sub-scanning signal and an even-numbered column of the subpixels in the second row by applying the second sub-scanning signal.

In some embodiments, before the operation of acquiring a first scanning drive signal, a second scanning drive signal and a preset data drive signal, reducing drive time duration of the first scanning drive signal to make the drive time duration of the first scanning drive signal shorter with respect to drive time duration of the preset data drive signal, the method also includes:

setting polarities of two adjacent ones of the subpixels opposite.

In some embodiments, the operation of taking two adjacent rows of the subpixels being scanned as a driving cycle, driving an even-numbered column of the subpixels in a first row of a driving cycle by applying the first main scanning signal, and driving an odd-numbered column of the subpixels in the first row in the driving cycle by applying the second main scanning signal; and driving an odd-numbered column of the subpixels in a second row in the driving cycle by applying the first sub-scanning signal and an even-numbered column of the subpixels in the second row in the driving cycle by applying the second sub-scanning signal, the method further includes:

driving two adjacent rows of the subpixels in a same column by applying one data drive signal.

In some embodiments, after the operation of driving two adjacent rows of the subpixels in a same column by applying one data drive signal, the method further includes:

driving two adjacent ones of the subpixels in a same column by applying the preset data drive signal, which is an average value of historical drive signals of the two subpixels.

In some embodiments, after the operation of acquiring the first scanning drive signal, the second scanning drive signal, and the preset data drive signal to shorten the driving time of the first scanning drive signal so that the driving time of the first scanning drive signal corresponds to the driving time of the preset data drive signal, the method further includes:

receiving an inversion signal, inverting the second scanning drive signal and the preset data drive signal according to the inversion signal to obtain an inverted second scanning drive signal and an inverted preset data drive signal, and reducing drive time of the inverted second scanning drive signal to make the drive time duration of the first scanning drive signal shorter with respect to drive time of the inverted preset data drive signal.

In addition, in order to achieve the above object, the present application also provides a driving device of display panel, the display panel includes a display array comprising pixels arranged in an array, each pixel consisting of three subpixels; and the driving device of the display panel includes:

an acquiring circuit, configured to acquire a first scanning drive signal, a second scanning drive signal and a preset data drive signal, reducing drive time duration of the first scanning drive signal to make the drive time duration of the first scanning drive signal shorter with respect to drive time duration of the preset data drive signal, the first scanning drive signal includes a first main scanning signal and a first sub-scanning signal, and the second scanning drive signal includes a second main scanning signal and a second sub-scanning signal; and a driving circuit, configured to take two adjacent rows of the subpixels being scanned as a driving cycle and drive an even-numbered column of the subpixels in a first row of a driving cycle by applying the first main scanning signal and driving an odd-numbered column of the subpixels in the first row by applying the second main scanning signal; and to drive an odd-numbered column of the subpixels in a second row in the driving cycle by applying the first sub-scanning signal and an even-numbered column of the subpixels in the second row by applying the second sub-scanning signal.

In addition, in order to achieve the above object, the present application also provides a display device, which includes a display panel, a memory, a processor and an executable instruction of the display panel stored in the memory and executable by the processor, the display panel includes a display array comprising pixels arranged in an array, one pixel consists of three subpixels, the processor executes the executable instruction, the executable instructions includes:

acquiring a first scanning drive signal, a second scanning drive signal and a preset data drive signal, reducing drive time duration of the first scanning drive signal to make the drive time duration of the first scanning drive signal shorter with respect to drive time duration of the preset data drive signal, the first scanning drive signal includes a first main scanning signal and a first sub-scanning signal, and the second scanning drive signal includes a second main scanning signal and a second sub-scanning signal; and taking two adjacent rows of the subpixels being scanned as a driving cycle, driving an even-numbered column of the subpixels in a first row of a driving cycle by applying the first main scanning signal, and driving an odd-numbered column of the subpixels in the first row by applying the second main scanning signal; and driving an odd-numbered column of the subpixels in a second row in the driving cycle by applying the first sub-scanning signal and an even-numbered column of the subpixels in the second row by applying the second sub-scanning signal.

In the display array of the display panel of the present application, one row of subpixels have two different scanning drive signals, the odd-numbered column of the subpixels and the even-numbered column of the subpixels in one row are respectively driven by applying different scanning drive signals, each row of the subpixels are driven by applying two different scanning drive signals, and driving time of the scanning drive signal relative to a data drive signal is controlled to make each driving time of the two scanning drive signals be different from each other, so that the charging capabilities of the subpixels in two rows under the scanning drive signals are different, and adjacent subpixels in the display array are alternately driven by a higher voltage or a lower voltage, thereby the color shift is reduced.

BRIEF DESCRIPTION OF THE DRAWINGS

FIG. 3*b* is a schematic diagram of driving timing of a display array in some embodiments of the present application.

FIG. 4 is a flow chart of a driving method of a display panel in some embodiments of the present application.

The realization, functional characteristics and advantages of the purpose of the present application will be further explained with reference to the attached drawings in combination with embodiments.

DETAILED DESCRIPTION OF THE EMBODIMENTS

It should be understood that the specific embodiments described herein are only for the purpose of explaining the present disclosure and are not intended to limit the present disclosure.

Figure 1:
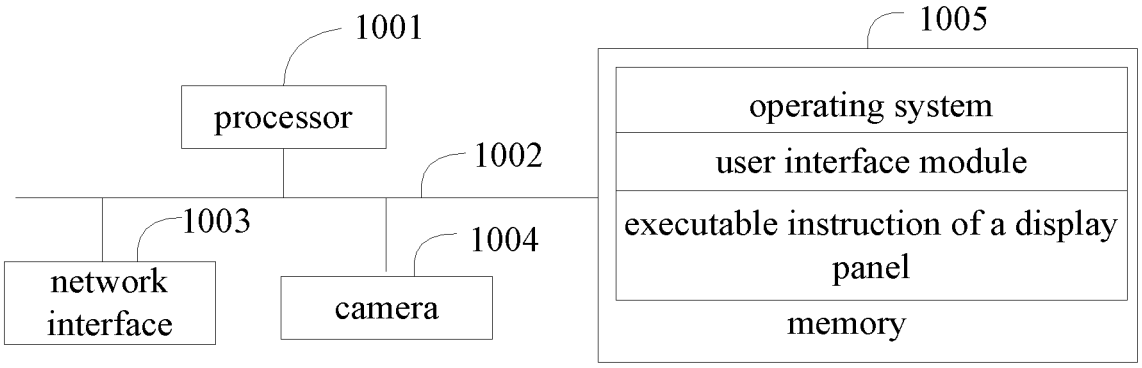
FIG. 1 is a schematic structural diagram of a display device in a hardware operating environment in some embodiments of the present application.

Referring to FIG. 1, FIG. 1 is a schematic structural diagram of a display device of a display panel in a hardware operating environment in some embodiments of the present application.

As shown in FIG. 1, the display device may include a processor 1001, such as a CPU, a communication bus 1002, a user interface 1003, a display panel 1004, and a memory 1005. The communication bus 1002 is configured to realize the communication between these components. The user interface 1003 may be configured to connect an input unit such as a keyboard. The memory 1005 may be a high-speed random access memory (RAM) or a non-volatile memory such as a disk memory. The memory 1005 may alternatively be a storage device independent of the aforementioned processor 1001, and the display panel 1004 may be a liquid crystal display panel or other display panels having same or similar functions.

Those skilled in the art will understand that the structure shown in FIG. 1 does not constitute a limitation on the display device, and may include more or fewer components than what is shown, or has some components combined, or different component arrangements.

As shown in FIG. 1, the memory 1005 as a storage medium may include an operating system user interface module and executable instructions of a display panel.

The display device of the present application calls the executable instruction of the display panel stored in the memory 1005 via the processor 1001 and executes the operations of the driving method of the display panel.

Based on the above hardware structure, some embodiments of the driving method of the display panel of the present application is provided.

Figure 2A:
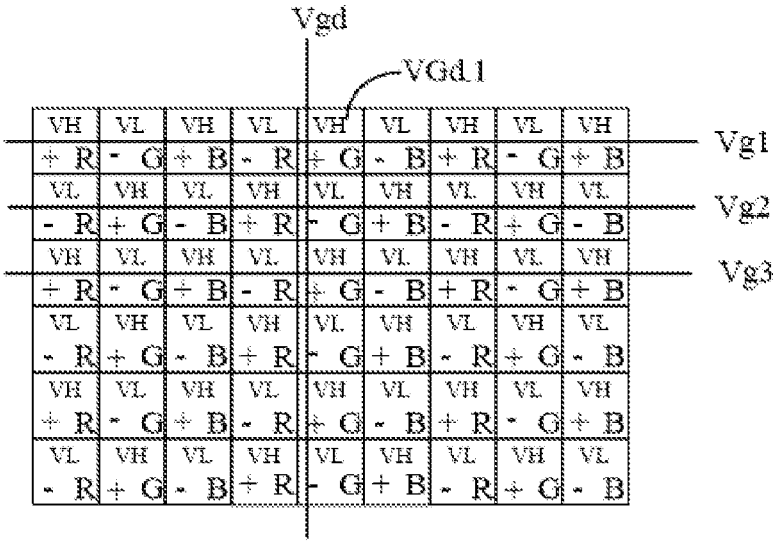
FIG. 2*a* is a schematic structural diagram of an exemplary display array.
Figure 2B:
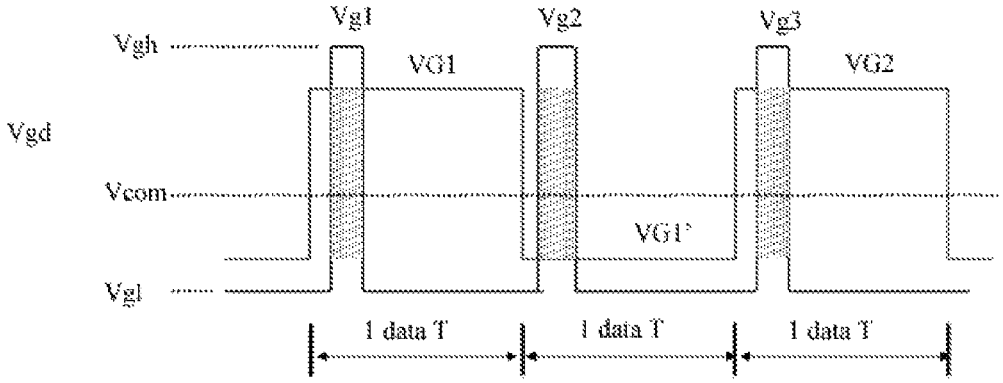
FIG. 2*b* is a schematic diagram of driving timing of an exemplary display array.

Referring to FIG. 2*a*, the schematic structural diagram of an exemplary display array, according to the original liquid crystal display panel, a scanning drive signal passes through one row of subpixels, and each row of the scanning drive signals is like the schematic diagram of drive timing of the exemplary display array illustrated in FIG. 2*b*. Vg1, Vg2, Vg3, etc. indicate that the driving voltages of each row of scanning drive signals are the same, and the corresponding relative timing and overlapping time of the scanning drive signals relative to the timing of the data drive signals are the same, so each subpixel has a same charging capability. It needs to interleave a high-voltage subpixel and a low-voltage subpixel for drive so as to improve color shift. Therefore, it needs to sequentially drive the subpixels with a higher or a lower data driving voltage Vgd according to the requirements of each subpixel. For example, shown in FIG. 2*a* are the high-voltage subpixel driving voltage VGd_1, the next adjacent low-voltage subpixel VGd_2, and a same column of the subpixels are sequentially driven by high-voltage and low-voltage subpixel signals. The load for driving IC may be increased corresponding to the increased driving frequency, and the power consumption of the driving IC and the risk of temperature rise of the driving IC are increased, due to the increase of the number of the subpixels in one row and the increase of panel resolution, when the difference in drive signals combines the difference in driving polarities of two adjacent subpixels.

Figure 3A:
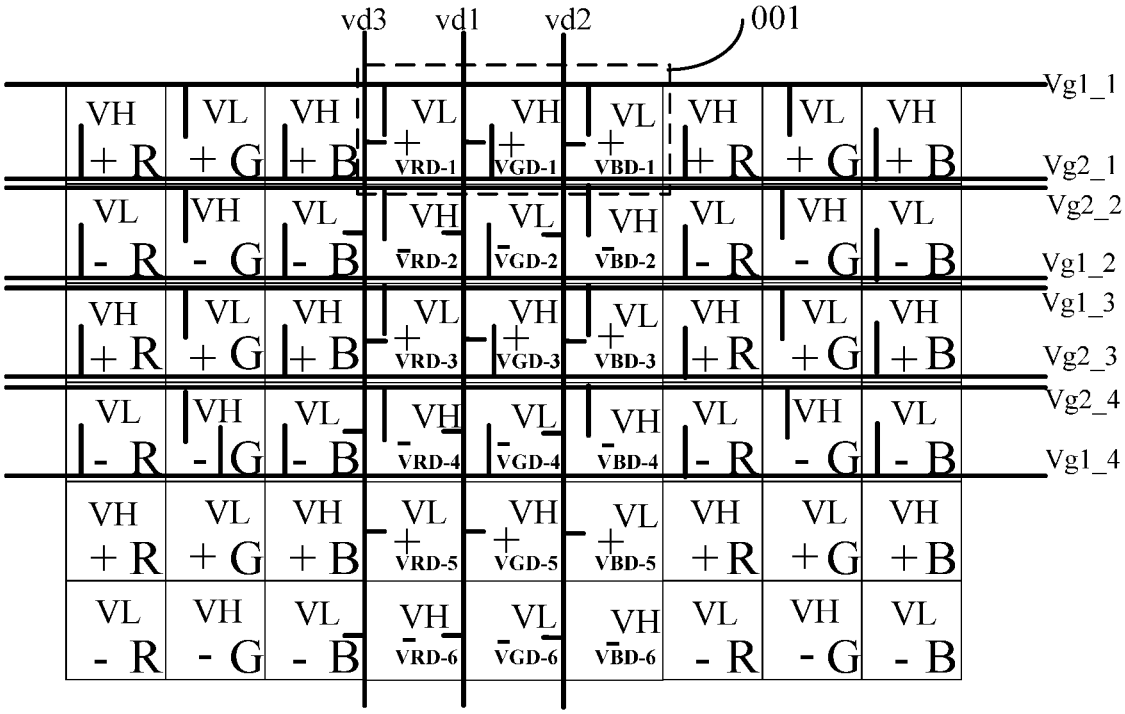
FIG. 3*a* is a schematic structural diagram of a display array in some embodiments of the present application.

Referring to FIG. 3*a*, which is a schematic structural diagram of a display array in the embodiment, FIG. 3*b* is a schematic diagram of the driving timing corresponding to the display array of the embodiment. The display panel of the display array may be a liquid crystal display panel or other display panels that may realize same or similar functions. The embodiment is not limited to this. In this embodiment, the liquid crystal display panel is taken as an example to illustrate, and the display panel includes a display array. The display array includes pixels arranged in an array, one pixel consists of three subpixels, the pixel includes a first pixel and a second pixel which are alternately arranged in a first direction and a second direction, the pixel includes a first subpixel, a second subpixel and a third subpixel, and the first subpixel, the second subpixel and the third subpixel respectively correspond to a red subpixel (R), a green subpixel (G) and a blue subpixel (B), the first direction is a row direction and the second direction is a column direction.

Referring to FIG. 4, FIG. 4 is a flowchart of a driving method of a display panel in a first embodiment of the present application.

In the first embodiment, the driving method of the display panel includes the following steps:

S10 acquiring a first scanning drive signal, a second scanning drive signal and a preset data drive signal, reducing drive time duration of the first scanning drive signal to make the drive time duration of the first scanning drive signal shorter with respect to drive time duration of the preset data drive signal, the first scanning drive signal includes a first main scanning signal and a first sub-scanning signal, and the second scanning drive signal includes a second main scanning signal and a second sub-scanning signal.

It should be noted that as shown in FIG. 3*a*, the first preset scanning drive signal is Vg1, the second preset scanning drive signal is Vg2, the preset data drive signal is Vgd, T−Δt in FIG. 3*b* is the driving time of the first preset scanning drive signal corresponding to the preset data drive signal, T is the drive time before improvement. It may be seen from the figure that the driving time of Vg1 relative to the preset data drive signal is reduced by Δt, so that the charging capacity of two subpixels adjacent to each other in a same column is different, and the charging capacity of the subpixels connected with Vg1 is smaller than that of the subpixels connected with Vg2, thereby leading to the alternating arrangement of two subpixels adjacent to each other in a same column with a high voltage and a low voltage.

S20 taking two adjacent rows of the subpixels being scanned as a driving cycle, driving an even-numbered column of the subpixels in a first row of a driving cycle by applying the first main scanning signal, and driving an odd-numbered column of the subpixels in the first row by applying the second main scanning signal; and driving an odd-numbered column of the subpixels in a second row in the driving cycle by applying the first sub-scanning signal and an even-numbered column of the subpixels in the second row by applying the second sub-scanning signal.

It should be noted that the voltage intensity of the subpixels may be divided into a low voltage (such as subpixels marked with L in FIGS. 2*a*, 3*a*, 4*c* and 6) and a high voltage (such as subpixels marked with H in FIGS. 2*a*, 3*a*, 4*c* and 6).

Understandably, the display gray scale of a high-voltage unit subpixel is relatively bright, while the display gray scale of a low-voltage unit subpixel is relatively dark. As shown in the figure above, the driving method of the embodiment finally enables the adjacent subpixels of the display array of the display panel to be arranged alternately with high and low voltage intensities.

As shown in FIG. 3*a* and the corresponding FIG. 4*b* of drive timing, in order to realize the alternating driving arrangement with high voltage and low voltage of adjacent R, G and B subpixels, Vg1_1 is the scanning drive circuit and scanning drive signal (named as a first main scanning signal) of even-numbered columns of the subpixels in the first row in the driving cycle, Vg2_1 is the scanning drive circuit and scanning drive signal (named as a second main scanning signal) of odd-numbered columns of the subpixels in the first row in the driving cycle. As may be seen from FIG. 3*a*, the first main scanning signal Vg1_1 and the second main scanning signal Vg2_1 jointly control the first row of subpixels of the driving cycle, that is, one row of the subpixels in the display array of the embodiment are designed with two scanning drive circuits.

Correspondingly, Vg2_2 is the scanning drive circuit and scanning drive signal (named second sub-scanning signal) of even-numbered columns of subpixels in the second row in the driving cycle, Vg1_2 is the scanning drive circuit and scanning drive signal (named first sub-scanning signal) of odd-numbered columns of subpixels in the second row of the drive cycle;

For convenience of description, the first main scanning signal Vg1_1 and the first sub-scanning signal Vg1_2 are collectively called a first scanning drive signal VG1; the second main scanning signal Vg2_1 and the second sub-scanning signal Vg2_2 are collectively called a second scanning drive signal Vg2.

It may be understood that Vg1_3 in FIG. 3*a* is the scanning drive circuit and the scanning drive signal (i.e., corresponding to the third row of subpixels in the display array in FIG. 3*a*) for even-numbered columns of subpixels in the first row of the next drive cycle, and Vg2_3 is the scanning drive circuit and the scanning drive signal (corresponding to the third row of subpixels in the display array in FIG. 3*a*) for odd-numbered columns of subpixels in the first row of the next drive cycle. Correspondingly, it may be understood that Vg2_4 is the scanning drive circuit and the scanning drive signal (i.e., corresponding to the fourth row of subpixels in the display array in FIG. 3*a*) for even-numbered columns of subpixels in the second row of the next drive cycle, and Vg1_4 is the scanning drive circuit and the scanning drive signal (corresponding to the fourth row of subpixels in the display array in FIG. 3*a*) for odd-numbered columns of subpixels in the second row of the next drive cycle.

As shown in the drive timing of FIG. 3*b*, one data drive circuit in the embodiment adopts a dot inversion for driving, and the overall display array adopts a row inversion arrangement for driving.

The driving time of the scanning drive signal relative to the data drive signal is controlled, and the driving time of Vg1 relative to that of Vg2 is changed from the original T1 to T1', and the subpixel charging time of Vg1 is reduced by T1-T1', so that the equivalent charging voltage of the corresponding subpixel is reduced to form a so-called low-voltage subpixel, and the purpose of charging the high-voltage subpixels and discharging the low-voltage subpixels is achieved.

It may be understood that the timing of the scanning switch of Vg1 is controlled to be shorter than the charging signal time of the data drive signal, and the timing of the scanning switch of Vg2 is controlled to be longer than the charging signal of the data drive signal, so that the charging capability of the subpixels corresponding to the Vg1 scanning driving circuit becomes worse, and the charging capability of the subpixels corresponding to the Vg2 scanning circuit becomes better. Thereby the difference between the charging of the high-voltage subpixel and the charging of the low-voltage subpixel is made, and subpixels adjacent to each other in a column direction in the display array are alternately arranged with a high and a low voltages, and further realizes that as a whole, the subpixels adjacent to each other of the display array are alternately arranged with a high voltage and a low voltage, thereby the color shift is improved.

In the display array of the display panel of the example, one row of subpixels have two different scanning drive signals (i.e., two different scanning drive lines), that is, the odd-numbered column of the subpixels and the even-numbered column of the subpixels in one row are respectively driven by applying different scanning drive signals, each row of the subpixels are driven by applying two different scanning drive signals at the same time, and driving time of the scanning drive signal relative to a data drive signal is controlled to make each driving time of the two scanning drive signals be different from each other, so that the charging capabilities of the subpixels in two rows under the scanning drive signals are different, and adjacent subpixels in the display array are alternately driven by a higher voltage and a lower voltage, thereby the color shift is reduced.

Optionally, before the operation S10, the method further includes:

setting the polarities of two adjacent ones of the subpixels opposite.

After the operation S20, the method further includes:

driving two adjacent rows of the subpixels in a same column by applying one data drive signal.

It may be understood that, as shown in FIG. 3*b*, the positive drive signals of the subpixels in row G are VG1, VG2, VG3, . . . , and the negative drive signals are G1', VG2', VG3', . . . . When under frame timing Frame1, the equivalent driving voltage VGd_1 of the high voltage subpixels is the positive drive signal Vgd=VG1, and the switching timing of the scanning drive signal Vg2-1 is longer than the charging signal time of the data drive signal, the adjacent low-voltage subpixel VGd_2 is the negative driving voltage Vgd=VG1', and the switching timing of the scanning drive signal of Vg1-2 is shorter than the charging signal time of the data drive signal, and the equivalent driving voltage VGd_1>VGd_2. Similarly, the equivalent driving voltage VGd_3 of the high voltage subpixels is the positive drive signal Vgd=VG2, and the switching timing of the scanning drive signal Vg2-3 is longer than the charging signal time of the data drive signal, the adjacent low-voltage subpixel VGd_4 is the negative driving voltage Vgd=VG2', and the switching timing of the scanning drive signal of Vg1-4 is shorter than the charging signal time of the data drive signal, and the equivalent driving voltage VGd_3>VGd_4. Thereby, subpixels adjacent to each other in a same column of the display array are alternately driven by a higher voltage and a lower voltage, thereby the color shift is reduced.

Optionally, after the operation of driving two adjacent rows of the subpixels in a same column by applying one data drive signal, the method also includes:

driving two adjacent ones of the subpixels in a same column by applying a preset data drive signal, which is an average value of historical drive signals of the two subpixels.

It should be noted that the historical drive signals of two adjacent subpixels are the drive signals of the two adjacent subpixels before improvement, the two adjacent subpixels are in a same column and respectively in two adjacent rows. In addition, the preset data drive signal in the embodiment represents at least two data drive signals, and the preset data drive signal represents the data drive signal Vd1, the data drive signal Vd2, and the data drive signal Vd3 in FIG. 3*a*.

Understandably, referring to FIG. 3*a*, the equivalent voltages VGd_1 and VGd_2 of two adjacent subpixels in a same column are respectively driven by the positive driving voltage Vgd=VG1 and the negative driving voltage Vgd=VG1', and the positive driving voltage VG1 and the negative driving voltage VG1' may optionally be the average signal of the original pixel signal Gd1 and signal Gd2, which is 0-255 signal in terms of 8-bit drive signals, i.e., G1=(Gd1+Gd2)/2. The positive driving voltage VG1 and the negative driving voltage VG1' correspond to G1 signal. The equivalent voltages of VGd_3 and VGd_4 are respectively driven by the positive driving voltage Vgd=VG2 and the negative driving voltage Vgd=V2', and may optionally be the average signal of the original display array pixel signal Gd3 and signal Gd4, which is 0-255 signal in terms of 8-bit drive signal, namely G2=(Gd3+Gd4)/2, and the positive driving voltage VG2 and the negative driving voltage VG2' correspond to the G2 signal.

Optionally, after the operation S10, the method further includes: receiving an inversion signal, inverting the second scanning drive signal and the preset data drive signal according to the inversion signal to obtain an inverted second scanning drive signal and an inverted preset data drive signal, and reducing drive time of the inverted second scanning drive signal to make the drive time duration of the first scanning drive signal shorter with respect to drive time of the inverted preset data drive signal.

As the timing of FIG. 3*b*, in combination with the G column subpixels of FIG. 3*a*, Vd1 data line drive G column and R column subpixels are in this order: positive subpixel VGd_1, negative subpixel VRd_2, positive subpixel VGd_3, negative subpixel VRd_4, positive subpixel VGd_5, and negative subpixel VRd_6. The corresponding scanning driving voltages are Vg2(Vg2_1, Vg2_2, Vg2_3, Vg2_4, Vg2_5, Vg2_6). The Vd2 data line drives the G and B subpixels: the positive subpixel VBd_1, the negative subpixel VGd_2, the positive sub-pixel VBd_3, the negative sub-pixel VGd_4, the positive sub-pixel VBd_5, and the negative sub-pixel VGd_6. The corresponding scanning drive voltage is Vg_1(Vg1_1, Vg1_2, Vg1_3, Vg1_4, Vg1_5, Vg1_6). The switching timing of the scanning drive signal Vg2 is longer than the correct charging signal time of the data drive signal, and the switching timing of the scanning drive signal of Vg1 is shorter than the correct charging signal time of the data drive signal.

Figure 5:
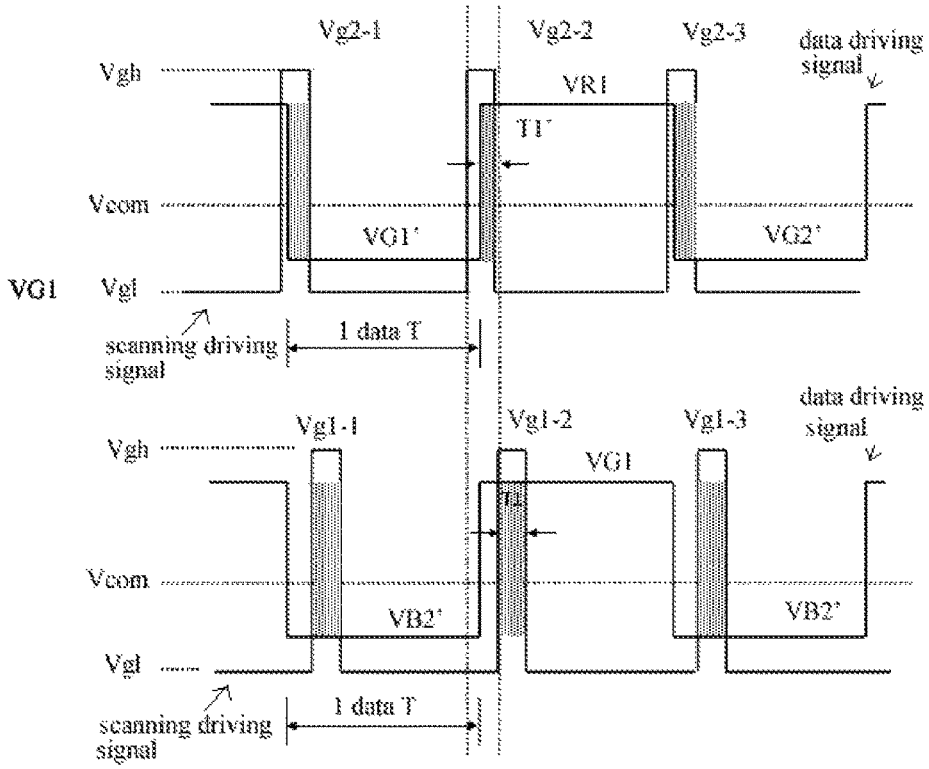
FIG. 5 is a schematic diagram of driving timing being reversed in some embodiments of the present application.

With the inversion of the drive signals of two adjacent frames, as shown in FIG. 5, the switch of the scanning drive signal is controlled corresponding to the charging time of the data drive signal, that is, the switching timing of the scanning drive signal Vg2 is shorter than the correct charging signal VG1' time T1' of the data drive signal, and the switching timing of the scanning drive signal of Vg1 is longer than the correct charging signal VG1 time T1 of the data drive signal. Thereby, the high-voltage signal subpixels and the low-voltage signal subpixels in different timing are realized, the difference between high-voltage subpixels and low-voltage subpixels may not be obvious for naked eye, and the resolution may not decrease as a result.

Figure 6:
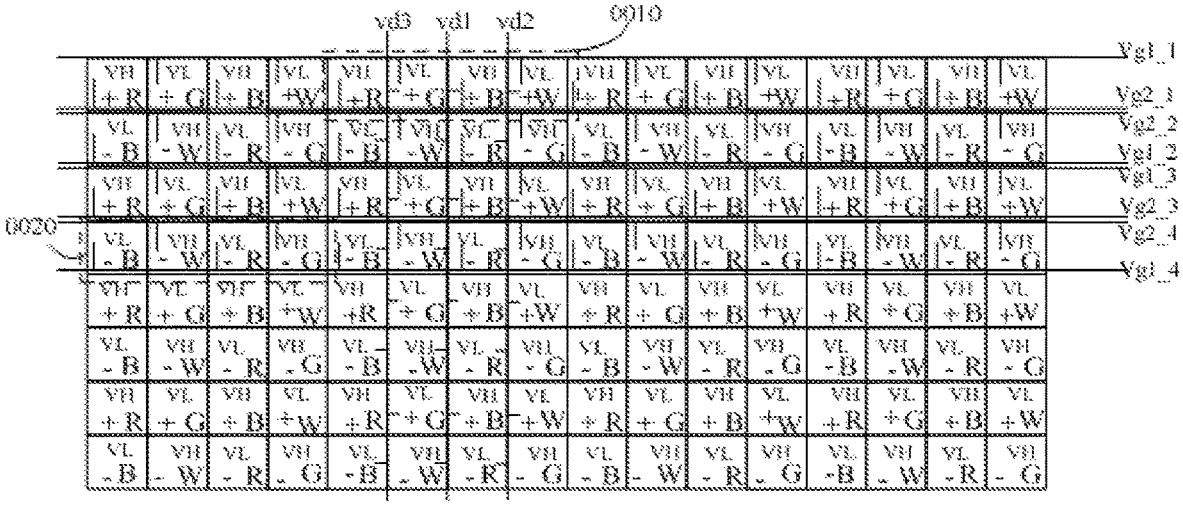
FIG. 6 is a schematic structural diagram of a display array in some other embodiments of the present application.

Optionally, referring to FIG. 6, the pixel includes a first pixel 0010 and a second pixel 0020 which are alternately arranged in a column direction, the first pixel includes a red subpixel, a green subpixel, a blue subpixel and a white subpixel which are sequentially arranged, and the second pixel includes a blue subpixel, a white subpixel, a red subpixel and a green subpixel which are sequentially arranged.

The operation S20 includes:

taking two adjacent rows of the subpixels being scanned as a driving cycle, driving the white subpixel and the green subpixel in the first row in the driving cycle by applying the first main scanning signal and the red subpixel and the blue subpixel in the first row in the driving cycle by applying the second main scanning signal; and driving the blue subpixel and the red subpixel in the second row in the driving cycle by applying the first sub-scanning signal and the white subpixel and the green subpixel in the second row in the driving cycle by applying the second sub-scanning signal.

As shown in FIG. 6, it is proposed to use WRGB subpixels as high-voltage and low-voltage drives to improve color shift. Two scanning circuits are set for the subpixels in the first row of the display array in FIG. 6. That is. the first main scanning signal Vg1_1 and the second main scanning signal Vg2_1 jointly drive the first row of subpixels, Vg1_1 drives the green subpixels and the white subpixels in the first row; the second main scanning signal Vg2_1 drives red subpixels and blue subpixels in the first row; the first sub-scanning signal Vg1_2 drives the blue subpixels and the red subpixels in the second row of the display array in FIG. 6, and the second sub-scanning signal Vg2_2 drives the white subpixels and the green subpixels in the second row. Similarly, the third row, the fourth row, the fifth row and the sixth row in FIG. 6 are driven in the same driving mode as above, and the display array in FIG. 6 adopts a dot inversion driving mode, so that each subpixel in WRGB in the display array in FIG. 6 is arranged alternately in high and low voltages to achieve the purpose of reducing color shift.

Figure 7:
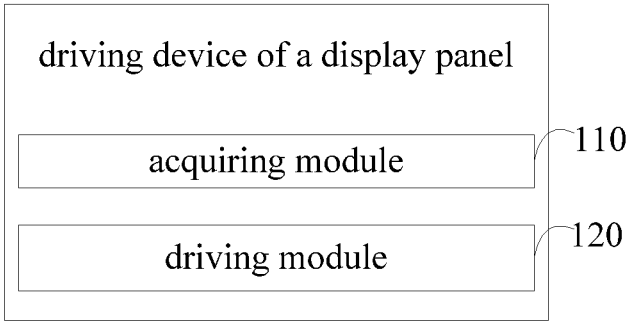
FIG. 7 is a schematic structural diagram of a display device in some embodiments of the present application.

In addition, the embodiment of the present application also provides a driving device of display panel. As shown in FIG. 7, the display panel includes a display array, the display array includes pixels arranged in an array, each pixel consists of three subpixels; and the driving device of the display panel includes:

an acquiring circuit 110 is configured to acquire a first scanning drive signal, a second scanning drive signal and a preset data drive signal, reducing drive time duration of the first scanning drive signal to make the drive time duration of the first scanning drive signal shorter with respect to drive time duration of the preset data drive signal, the first scanning drive signal includes a first main scanning signal and a first sub-scanning signal, and the second scanning drive signal includes a second main scanning signal and a second sub-scanning signal.

a driving circuit 120 is configured to take two adjacent rows of the subpixels being scanned as a driving cycle and drive an even-numbered column of the subpixels in a first row of a driving cycle by applying the first main scanning signal and driving an odd-numbered column of the subpixels in the first row by applying the second main scanning signal; and to drive an odd-numbered column of the subpixels in a second row in the driving cycle by applying the first sub-scanning signal and an even-numbered column of the subpixels in the second row by applying the second sub-scanning signal.

The driving circuit 120 of the driving device of display panel may include a scanning unit and a driving unit, the scanning unit is configured to output a scanning drive signal, which generally scans the pixels row by row; and the driving unit outputs data drive signals to enable the pixels to receive driving data for display when being scanned.

Optionally, the polarities of two adjacent subpixels are opposite.

Optionally, the driving circuit is configured to drive two adjacent rows of the subpixels in a same column by applying one data drive signal.

Optionally, the driving circuit is configured to drive two adjacent ones of the subpixels in a same column by applying a preset data drive signal, which is an average value of historical drive signals of the two subpixels.

Optionally, the pixel includes a first pixel and a second pixel which are alternately arranged in a column direction, the first pixel includes a red subpixel, a green subpixel, a blue subpixel and a white subpixel which are sequentially arranged, and the second pixel includes a blue subpixel, a white subpixel, a red subpixel and a green subpixel which are sequentially arranged; the driving circuit is configured to take two adjacent rows of the subpixels being scanned as a driving cycle and drive a white subpixel and a green subpixel in a first row of a driving cycle by applying the first main scanning signal and a red subpixel and a blue subpixel in the first row of a driving cycle by applying the second main scanning signal; and the blue subpixel and the red subpixel in the second row in the driving cycle are driven by applying the first sub-scanning signal and the white subpixel and the green subpixel in the second row in the driving cycle by applying the second sub-scanning signal.

Optionally, the driving circuit is configured to set a polarity of the negative subpixels positive and a polarity of the positive subpixels negative, after each of the pixels in the second row in the driving cycle being driven by the first sub-scanning signal and the second sub-scanning signal.

The specific embodiment of the driving device in the example may refer to the driving method of display panel in the above-mentioned example, and the present example will not repeat here.

The above description is only an alternative embodiment of the present application, and is not intended to limit the patent scope of the present application. Any equivalent structural changes made by applying the description and drawings of the present application or direct/indirect application in other related technical fields are included in the patent protection scope of the present application under the concept of the present application.

What is claimed is:

1. A driving method of a display panel, wherein the display panel comprises a display array comprising pixels arranged in an array, each of the pixels consisting of three subpixels; and the driving method of the display panel comprises:

acquiring a first scanning drive signal, a second scanning drive signal and a preset data drive signal, reducing a drive time duration of the first scanning drive signal to make the drive time duration of the first scanning drive signal shorter with respect to a drive time duration of the preset data drive signal, wherein the first scanning drive signal comprises a first main scanning signal and a first sub-scanning signal, and the second scanning drive signal includes a second main scanning signal and a second sub-scanning signal; and taking two adjacent rows of the subpixels being scanned as a driving cycle, driving an even-numbered column of the subpixels in a first row in the driving cycle by applying the first main scanning signal, and driving an odd-numbered column of the subpixels in the first row by applying the second main scanning signal; and driving an odd-numbered column of the subpixels in a second row in the driving cycle by applying the first sub-scanning signal and driving an even-numbered column of the subpixels in the second row by applying the second sub-scanning signal.

2. The driving method according to claim 1, wherein before the operation of acquiring a first scanning drive signal, a second scanning drive signal and a preset data drive signal, reducing a drive time duration of the first scanning drive signal to make the drive time duration of the first scanning drive signal shorter with respect to a drive time duration of the preset data drive signal, the method further comprises:

setting polarities of two adjacent ones of the subpixels opposite.

3. The driving method according to claim 1, wherein after the operation of taking two adjacent rows of the subpixels being scanned as a driving cycle, driving an even-numbered column of the subpixels in a first row in the driving cycle by applying the first main scanning signal, and driving an odd-numbered column of the subpixels in the first row by applying the second main scanning signal; and driving an odd-numbered column of the subpixels in a second row in the driving cycle by applying the first sub-scanning signal and an even-numbered column of the subpixels in the second row by applying the second sub-scanning signal, the method further comprises:

driving two adjacent rows of the subpixels in a same column by applying a same data drive signal.

4. The driving method according to claim 3, wherein after the operation of driving two adjacent rows of the subpixels in a same column by applying a same data drive signal, the method further comprises:

driving two adjacent ones of the subpixels in the same column by applying the preset data drive signal, which is an average value of historical drive signals of the two adjacent subpixels.

5. The driving method according to claim 1, wherein after the operation of acquiring a first scanning drive signal, a second scanning drive signal and a preset data drive signal, reducing a drive time duration of the first scanning drive signal to make the drive time duration of the first scanning drive signal shorter with respect to a drive time duration of the preset data drive signal, the method further comprises:

receiving an inversion signal, inverting the second scanning drive signal and the preset data drive signal according to the inversion signal, to obtain an inverted second scanning drive signal and an inverted preset data drive signal, and reducing a drive time duration of the inverted second scanning drive signal to make the drive time duration of the first scanning drive signal shortened with respect to drive time duration of the inverted preset data drive signal.

6. The driving method according to claim 1, wherein the pixel comprises a first pixel and a second pixel which are alternately arranged in a column direction, wherein the first pixel comprises a red subpixel, a green subpixel, a blue subpixel and a white subpixel which are sequentially arranged, and the second pixel comprises a blue subpixel, a white subpixel, a red subpixel and a green subpixel which are sequentially arranged;

wherein the operation of taking two adjacent rows of the subpixels being scanned as a driving cycle, driving an even-numbered column of the subpixels in a first row in the driving cycle by applying the first main scanning signal, and driving an odd-numbered column of the subpixels in the first row by applying the second main scanning signal; and driving an odd-numbered column of the subpixels in a second row in the driving cycle by applying the first sub-scanning signal and an even-numbered column of the subpixels in the second row by applying the second sub-scanning signal, comprises:

taking two adjacent rows of the subpixels being scanned as the driving cycle, driving the white subpixel and the green subpixel in the first row in the driving cycle by applying the first main scanning signal and the red subpixel and the blue subpixel in the first row in the driving cycle by applying the second main scanning signal; and driving the blue subpixel and the red subpixel in the second row in the driving cycle by applying the first sub-scanning signal and the white subpixel and the green subpixel in the second row in the driving cycle by applying the second sub-scanning signal.

7. The driving method according to claim 6, wherein the driving method further comprises:

setting negative subpixels positive and positive subpixels negative, after each of the pixels in the second row in the driving cycle is driven by the first sub-scanning signal and the second sub-scanning signal.

8. A driving device of display panel, wherein the display panel comprises a display array comprising pixels arranged in an array, each of the pixels consists of three subpixels; and the driving device of the display panel comprises:

an acquiring circuit, configured to acquire a first scanning drive signal, a second scanning drive signal and a preset data drive signal, reducing a drive time duration of the first scanning drive signal to make the drive time duration of the first scanning drive signal shorter with respect to a drive time duration of the preset data drive signal, wherein the first scanning drive signal comprises a first main scanning signal and a first sub-scanning signal, and the second scanning drive signal includes a second main scanning signal and a second sub-scanning signal; and a driving circuit, configured to take two adjacent rows of the subpixels being scanned as a driving cycle, drive an even-numbered column of the subpixels in a first row in the driving cycle by applying the first main scanning signal and drive an odd-numbered column of the subpixels in the first row by applying the second main scanning signal; and drive an odd-numbered column of the subpixels in a second row in the driving cycle by applying the first sub-scanning signal and drive an even-numbered column of the subpixels in the second row by applying the second sub-scanning signal.

9. The driving device according to claim 8, wherein polarities of two adjacent ones of the subpixels are opposite.

10. The driving device according to claim 9, wherein the driving circuit is configured to drive two adjacent rows of the subpixels in a same column by applying one data drive signal.

11. The driving device according to claim 10, wherein the driving circuit is configured to drive two adjacent ones of the subpixels in a same column by applying the preset data drive signal, which is an average value of historical drive signals of the two adjacent subpixels.

12. The driving device according to claim 11, wherein the pixel comprises a first pixel and a second pixel which are alternately arranged in a column direction, wherein the first pixel comprises a red subpixel, a green subpixel, a blue subpixel and a white subpixel which are sequentially arranged, and the second pixel comprises a blue subpixel, a white subpixel, a red subpixel and a green subpixel which are sequentially arranged;

the driving circuit is configured to take two adjacent rows of the subpixels being scanned as a driving cycle and drive a white subpixel and a green subpixel in a first row of a driving cycle by applying the first main scanning signal and a red subpixel and a blue subpixel in the first row of a driving cycle by applying the second main scanning signal; and drive the blue subpixel and the red subpixel in the second row in the driving cycle by applying the first sub-scanning signal and the white subpixel and the green subpixel in the second row in the driving cycle by applying the second sub-scanning signal.

13. The driving device according to claim 12, wherein the driving circuit is configured to set a polarity of negative subpixels positive and a polarity of positive subpixels negative, after each of the pixels in the second row in the driving cycle being driven by the first sub-scanning signal and the second sub-scanning signal.

14. A display device, wherein the display device comprises: a display panel, a memory, a processor, and an executable instruction of the display panel stored in the memory and executed by the processor, wherein the display panel comprises a display array comprising pixels arranged in an array, each of the pixels consisting of three subpixels, the processor executing the executable instruction to implement:

acquiring a first scanning drive signal, a second scanning drive signal and a preset data drive signal, reducing drive time duration of the first scanning drive signal to make the drive time duration of the first scanning drive signal shorter with respect to drive time of the preset data drive signal, wherein the first scanning drive signal comprises a first main scanning signal and a first sub-scanning signal, and the second scanning drive signal includes a second main scanning signal and a second sub-scanning signal; and taking two adjacent rows of the subpixels being scanned as a driving cycle, driving an even-numbered column of the subpixels in a first row of a driving cycle by applying the first main scanning signal, and driving an odd-numbered column of the subpixels in the first row by applying the second main scanning signal; and driving an odd-numbered column of the subpixels in a second row in the driving cycle by applying the first sub-scanning signal and driving an even-numbered column of the subpixels in the second row by applying the second sub-scanning signal.

15. The display device according to claim 14, wherein polarities of two adjacent ones of the subpixels are opposite.

16. The display device according to claim 15, wherein the processor executes the executable instruction to implement:

driving two adjacent rows of the subpixels in a same column by applying one data drive signal.

17. The display device according to claim 16, wherein the processor executes the executable instruction to implement:

driving two adjacent ones of the subpixels in a same column by applying the preset data drive signal, which is an average value of historical drive signals of the two adjacent subpixels.

18. The display device according to claim 17, wherein the processor executes the executable instruction to implement: receiving an inversion signal, inverting the second scanning drive signal and the preset data drive signal according to the inversion signal to obtain an inverted second scanning drive signal and an inverted preset data drive signal, and reducing a drive time of the inverted second scanning drive signal to make the drive time duration of the first scanning drive signal shorter with respect to drive time of the inverted preset data drive signal.

19. The display device according to claim 14, wherein the pixel comprises a first pixel and a second pixel which are alternately arranged in a column direction, wherein the first pixel comprises a red subpixel, a green subpixel, a blue subpixel and a white subpixel which are sequentially arranged, and the second pixel comprises a blue subpixel, a white subpixel, a red subpixel and a green subpixel which are sequentially arranged;

the processor executes the executable instruction to implement: taking two adjacent rows of the subpixels being scanned as a driving cycle, driving the white subpixel and the green subpixel in the first row in the driving cycle by applying the first main scanning signal and the red subpixel and the blue subpixel in the first row in the driving cycle by applying the second main scanning signal; and driving the blue subpixel and the red subpixel in the second row in the driving cycle by applying the first sub-scanning signal and the white subpixel and the green subpixel in the second row in the driving cycle by applying the second sub-scanning signal.

20. The display device according to claim 19, wherein the processor executes the executable instruction to implement:

setting a polarity of negative subpixels positive and a polarity of positive subpixels negative, after each of the pixels in the second row in the driving cycle being driven by the first sub-scanning signal and the second sub-scanning signal.

* * * * *